United States Patent [19]

Weiss et al.

[11] Patent Number: 4,563,203

[45] Date of Patent: Jan. 7, 1986

[54] REFRIGERATION FROM EXPANSION OF TRANSMISSION PIPELINE GAS

[75] Inventors: Irving Weiss, Merrick; Hans P. Schorr, Douglaston, both of N.Y.

[73] Assignees: Kryos Energy Inc., New York, N.Y.; by said Irving Weiss; The Brooklyn Union Gas Company, Brooklyn, N.Y; by said Hans P. Schorr

[21] Appl. No.: 601,013

[22] Filed: Apr. 16, 1984

[51] Int. Cl.[4] ..... F25J 3/00

[52] U.S. Cl. ..... 62/20; 62/38

[58] Field of Search ..... 62/38, 39, 17, 20, 24-31

[56] References Cited

U.S. PATENT DOCUMENTS 3,002,362 10/1961 Morrison .

4,251,249 2/1981 Gulsby ..... 62/38

4,419,114 12/1983 May et al. ..... 62/17

*Primary Examiner*—Frank Sever

*Attorney, Agent, or Firm*—Paul W. Garbo

[57] ABSTRACT

Refrigeration is produced while delivering transmission pipeline gas of elevated pressure to a branch pipeline of lower pressure by expanding the gas in a turbo-expander to a pressure below the branch pipeline pressure and recovering refrigeration from the expanded gas which is then compressed by a centrifugal compressor directly driven by the turbo-expander to the pressure required for delivery into the branch pipeline. Preferably, the gas is dehydrated by adding methanol and separating aqueous methanol condensate from the expanded gas, and the condensate is distilled with compression heat to recover methanol for reuse.

17 Claims, 3 Drawing Figures

REFRIGERATION FROM EXPANSION OF TRANSMISSION PIPELINE GAS

BACKGROUND OF THE INVENTION

This invention relates to the production of refrigeration during the reduction of pressure of gas withdrawn from a transmission pipeline. More specifically, the invention produces refrigeration with energy recovered when gas at elevated pressure in a transmission pipeline is supplied to a branch or regional pipeline maintained at a lower high pressure.

The gas pressure of transmission or trunk pipelines is reduced at many letdown stations or city gates simply by isenthalpic expansion, i.e., by passage through a reducing valve. Such pressure reduction is a waste of valuable energy.

Two schemes for utilizing the energy available in pipeline gas at letdown control stations are the generation of electrical energy and the liquefaction of natural gas. To produce electrical energy, the pipeline gas is passed through an expansion turbine which drives an electric generator. U.S. Pat. No. 3,360,944 illustrates a process wherein pipeline natural gas is expanded with the performance of work to produce refrigeration utilized to liquefy a portion of the natural gas.

Depending on the location of each letdown control station, the generation of electric energy or the production of liquified natural gas may not be economically attractive. In such case, the conversion of the energy available in the transmission pipeline gas reaching the letdown station to bulk, low-cost refrigeration may be a preferred and valuable alternative particularly where local industries require refrigeration. The frozen food industry, supplies of ice and manufacturers of dry ice are examples of industries which consume large quantities of refrigeration and thus represent potential customers of commercially saleable refrigeration.

Accordingly, a principal object of this invention is to convert energy derived from reducing the pressure of transmission pipeline gas to low-cost refrigeration.

Another important object is to maximize the generation of refrigeration by isentropic expansion of the transmission pipeline gas, i.e., expansion with the performance of work.

These and other objects and advantages of the invention will be evident from the description which follows.

SUMMARY OF THE INVENTION

In accordance with this invention, transmission pipeline gas reaching a letdown station generally at a pressure in the range of about 400 to 1000 psia, more frequently in the range of about 500 to 800 psia (pounds per square inch absolute), is expanded in a turbo-expander to a reduced pressure which is in most cases at least 50 psi below the desired delivery pressure but is not reduced enough to drop the temperature of the expanded gas below about −100° F., recovering refrigeration from the expanded gas, and thereafter compressing the expanded gas to the delivery pressure in a centrifugal compressor driven by the turbo-expander.

The gas pressure is often reduced by the expander at least 250 psi to a reduced pressure which is below the ultimate delivery pressure but which does not drop the temperature of the expanded gas below about −100° F. Limiting the reduction of pressure so that the temperature does not fall below about −100° F. avoids excessive condensation of hydrocarbons usually present in natural gas. Furthermore, there is no significant commercial market for the very low temperature refrigeration that is recoverable from expanded gas having a temperature below −100° F. Low level refrigeration is generally recovered from the expanded gas at a temperature below about −40° F., and if desired, additional high level refrigeration is recoverable at a temperature below about 20° F. Prior to entering the turbo-expander, the transmission pipeline gas is desirably cooled, usually to a temperature below about 45° F., by heat exchange with the expanded gas after refrigeration has been recovered therefrom so that the recovered refrigeration is at a lower temperature that it would be without such prior cooling. The warmed expanded gas is passed through the centrifugal compressor which increases the pressure so that the gas can be delivered at the desired pressure in the range of about 200 to 450 psia, frequently in the range of about 250 to 350 psia.

Transmission pipeline gas is herein used to mean natural gas or synthetic natural gas having a very high methane content and a heating value of at least about 950 British Thermal Units per standard cubic foot. Transmission pipeline gas reaching letdown stations invariably contains moisture which would freeze during the expansion of the gas and cause plugging of the equipment with possible damage thereto. A simple and inexpensive method of removing moisture from the pipeline gas involves the injection of a small quantity of methanol into the gas so that the moisture merely condenses during expansion of the gas and is separated from the expanded gas as a water-methanol solution. This method has been integrated with the novel generation of refrigeration according to this invention so that some of the energy derived from reducing the pressure of the pipeline gas is utilized to separate methanol from the water-methanol solution. Thus, regenerated methanol can be recycled for injection into transmission pipeline gas to be work expanded according to this invention.

BRIEF DESCRIPTION OF THE DRAWINGS

For further clarification of the invention, the ensuing description will refer to the appended drawings of which:

FIG. 2 as modified by FIG. 3 is the flow diagram of another preferred embodiment of the invention yielding both low level and high level refrigeration.

DESCRIPTION OF PREFERRED EMBODIMENTS

Figure 1:
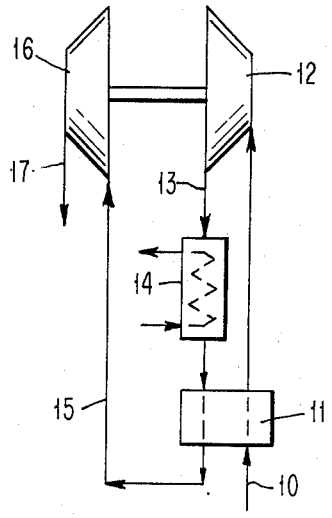
FIG. 1 is a flow diagram of the basic process of the invention whereby refrigeration is produced while reducing the high pressure of transmission pipeline gas to the lower high pressure of a branch or regional pipeline into which the gas is discharged.

FIG. 1 is a flow diagram of the basic process of the invention which can be used with dehydrated transmission pipeline gas at a pressure in the range of about 400 to 1000 psia. The gas may be dehydrated by passage through a bed of desiccant particles such as pellets of a molecular sieve. Such dehydrated high pressure gas in line 10 flows through heat exchanger 11, wherein it is cooled, to turbo-expander 12 where the pressure is reduced at least 250 psi to a reduced pressure below the desired delivery pressure at which reduced pressure the temperature of the expanded gas is not below about −100° F. The resulting cold expanded gas leaves expander 12 through line 13 which passes through refrigeration recovery exchanger 14 and exchanger 11. The thus warmed expanded gas flow via line 15 to centrifugal compressor 16 driven by expander 12. Compressor 16 increases the gas pressure so that the gas can be delivered at the desired pressure of at least 200 psia.

By reducing the pressure of the transmission pipeline gas by work expansion to a pressure below that of the branch line to which the gas is supplied, the invention maximizes the production of refrigeration. Yet the expanded gas is compressed up to the predetermined pressure of the branch line without requiring energy from an external source. Antifreeze or other suitable fluid is passed through refrigeration exchanger 14 to convey the recovered refrigeration to one or more operations requiring refrigeration, such as the commercial freezing of fish and meat.

Figure 2:
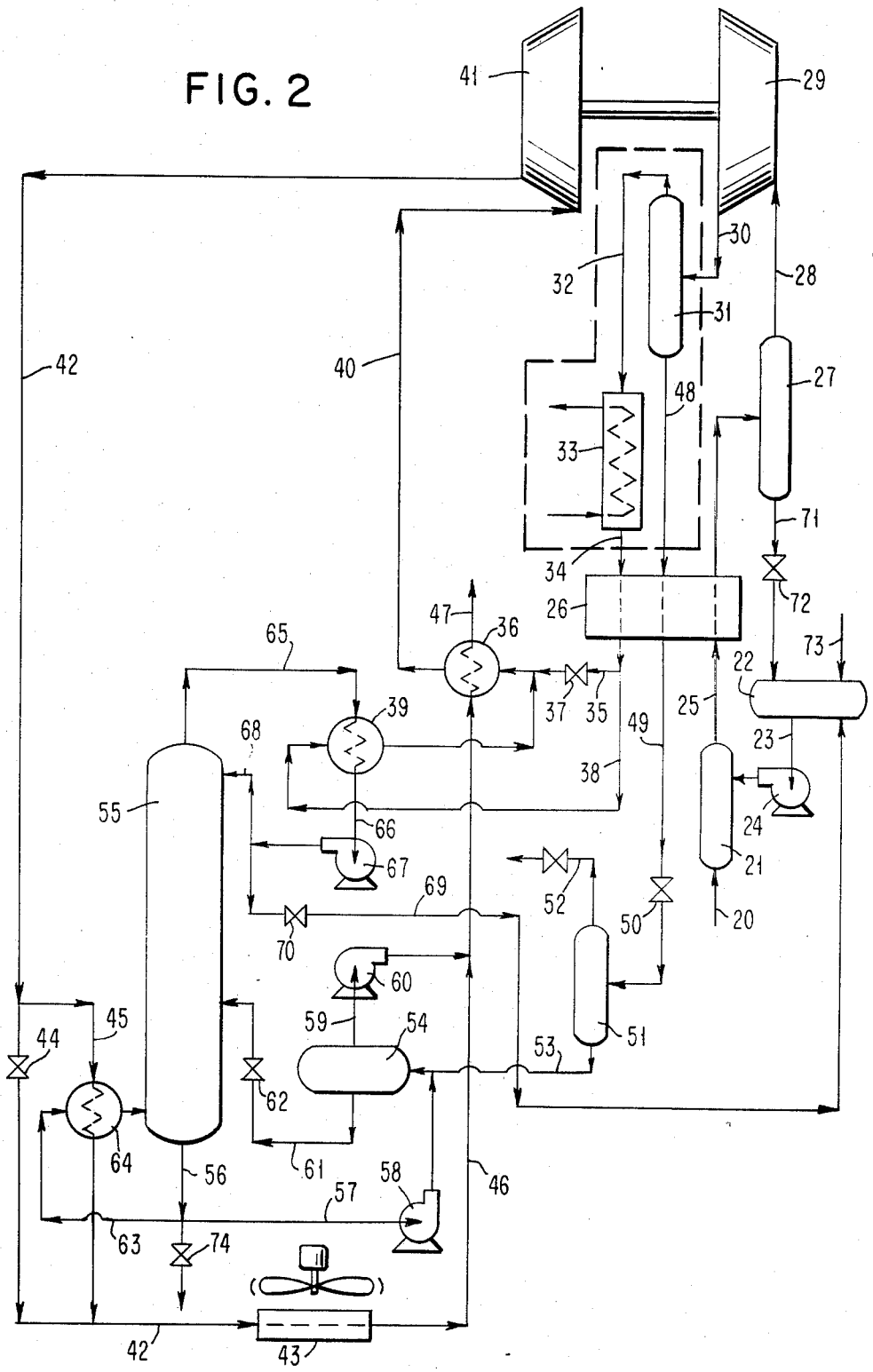
FIG. 2 is a flow diagram of a preferred embodiment of the invention in which the dehydration of the pipeline gas is integrated with the production of low level refrigeration.

FIG. 2 is a flow diagram of the basic process of the invention just described with reference to FIG. 1 but modified to incorporate the preferred method of eliminating the moisture usually present in pipeline gas through the use of methanol. The description of FIG. 2 will include a specific example of a transmission pipeline feeding a branch pipeline with gas which is substantially pure methane containing small amounts of moisture, carbon dioxide and higher hydrocarbons.

The transmission pipeline gas at a pressure of 615 psia and a temperature of 60° F. in line 20 enters the bottom of tower 21 and flows upwardly through a spray of methanol supplied from tank 22 by line 23 and pump 24. Methanol is injected into tower 21 at the rate of about 200 pounds per million standard cubic feet of gas passing through tower 21. The gas with vaporized methanol leaves tower 21 through line 25, passes through heat exchanger 26 and discharges into separator 27 at 610 psia and 37° F. wherein condensed methanol is removed from the gas before it enters turbo-expander 29 via line 28. The gas expanded with very little liquefaction of hydrocarbons such as propane and butane leaves expander 29 at 230 psia and −60° F., discharging from line 30 into separator 31 wherein an aqueous methanol condensate is removed from the expanded cold gas which then flows through line 32 to refrigeration recovery exchanger 33. The gas exits from exchanger 33 at 227 psia and −10° F., flowing through line 34 to exchanger 26.

The gas issues from exchanger 26 at 224 psia and 18° F. by way of line 35 which conveys the gas to heat exchanger 36. Control valve 37 in line 35 is used to divert about 6.5% of the gas leaving exchanger 26 into branch line 38 which directs this minor stream through reflux condenser 39 and thence at 221 psia and 100° F. back into line 35 before it reaches exchanger 36. The recombined stream at 221 psia and 23° F. enters exchanger 36 and flows therefrom at 215 psia and 155° F. via line 40 to centrifugal compressor 41 which is directly driven by turbo-expander 29. The gas compressed to 316 psia and 230° F. passes through line 42 to air cooler 43. Control valve 44 in line 42 is used to divert about 30% of the gas in line 42 through branch line 45 and reboiler 64 whence at 313 psia and 215° F. it returns to line 42. The recombined stream of compressed gas flows from air cooler 43 at 310 psia and 195° F. through line 46 and exchanger 36 from which it discharges into branch pipeline 47 at its normal operating conditions of 305 psia and 70° F.

The aqueous methanol condensate removed from the expanded gas in separator 31 at 230 psia and −60° F. flows through line 48 and exchanger 26 whence it issues at 225 psia and 18° F. via line 49 provided with reducing valve 50. The condensate passing through valve 50 discharges into separator 51 at about 23 psia. Traces of gases released from the condensate are vented from separator 51 through valved line 52. The condensate flows from separator 51 through line 53 into mixing tank 54. Warm water at 205° F. drawn from the bottom of distillation column 55 through line 56 is passed by line 57 and pump 58 for admixture with the aqueous methanol of line 53 discharged into tank 54. The warm mixture causes the small quantity of hydrocarbons that may have been carried in solution by the aqueous methanol into tank 54 to separate out as a supernatant layer on the aqueous methanol. The separated hydrocarbon layer is removed from tank 54 by line 59 and pump 60 and in most cases is injected into the compressed gas before it is delivered to branch pipeline 47.

The bottom layer of aqueous methanol passes from tank 54 through line 61 and control valve 62 into an intermediate section of column 55. The distillation separates the aqueous methanol into methanol vapor which rises to the top of column 55 and into water bottoms. Water in the bottom of column 55 circulates through line 56, line 63 and reboiler 64, discharging back into column 55 to supply the heat required for the distillation. Valved line 74 is used to drain water from column 55 as required.

Methanol vapor passes from the top of column 55 via line 65 to reflux condenser 39, discharging therefrom as liquid methanol into line 66. Thence pump 67 returns part of the liquid methanol through line 68 as reflux into the top of column 55 while part is returned via line 69 to storage tank 22. The division of the liquid flow from pump 67 into lines 68 and 69 is controlled by valve 70. The methanol recovered by distillation in column 55 and returned by line 69 to tank 22 together with condensed methanol discharged from separator 27 through line 71 and reducing valve 72 into tank 22 for recycling through line 23 and pump 24 to tower 21 amounts to almost 99.5% of the methanol injected into tower 21. In other words, slightly more than one pound of methanol is lost, almost entirely with the water drained from column 55 by valved line 65, for each million standard cubic feet of gas passing through tower 21. Fresh methanol is supplied by line 73 to tank 22 to replenish the very small quantity of methanol lost in the dehydration of the transmission pipeline gas.

For each million standard cubic feet of transmission pipeline gas processed per hour according to the process of FIG. 2, 95 tons of refrigeration at a temperature level of about −55° F. are recovered by antifreeze flowing through exchanger 33 for delivery to an operation requiring such low level refrigeration. Hence, the invention makes it possible to generate a substantial tonnage of valuable refrigeration solely from energy that would be wasted if the pressure of the transmission pipeline gas were reduced by isenthalpic expansion as practiced at many letdown control stations.

By work expanding transmission pipeline gas to a pressure below the pressure maintained in a regional or branch pipeline and then recompressing the expanded gas to the pressure required for delivering the gas to the branch pipeline, the invention achieves two noteworthy results that cannot be obtained if the gas is work expanded to the required delivery pressure and thus recompression is eliminated. The invention generates refrigeration at a lower temperature level than would otherwise be reached and the amount of refrigeration is increased about 30 to 50% depending on the starting pressure of the transmission pipeline gas and the ultimate delivery pressure at the branch pipeline.

Another feature of the invention is the use of exchanger 36 to transfer heat from the recompressed gas of line 46 to the gas in line 35 before it passes through compressor 41. Because of this heat transfer, the recompressed gas in line 42 is made hot enough that part can be passed through reboiler 64 to supply all the heat required by distillation column 55. Thus, the need to provide heat to column 55 from an external source is obviated.

Figure 3:
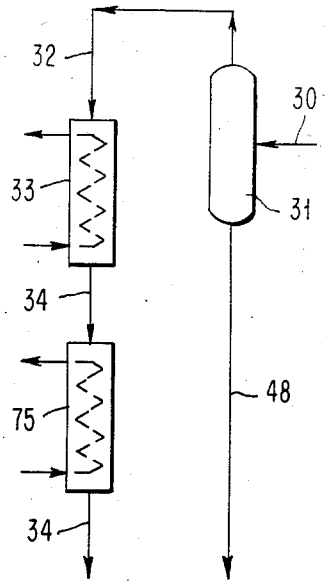
FIG. 3 is a partial flow diagram showing a modification of the portion of FIG. 2 indicated thereon within an encircling dotted line.

FIG. 3 shows a modification of the flow diagram of FIG. 2 which permits the recovery of refrigeration at two temperature levels. Reference numerals appearing in FIG. 2 are applied to corresponding elements of FIG. 3. The only new element in FIG. 3 is a high level refrigeration recovery exchanger with reference numeral 75 which is placed in line 34 between refrigeration recovery exchanger 33 and exchanger 26.

In the specific example that has been presented in connection with the flow diagram of FIG. 2, the modification of FIG. 3 does not change any of the pressure and temperature conditions previously mentioned, starting at line 20 and proceeding to the discharge from refrigeration exchanger 33 into line 34 where, as previously stated, the gas is at 227 psia and −10° F. Now that refrigeration recovery exchanger 75 is interposed in line 34 the gas gives up additional refrigeration and leaves exchanger 75 at 224 psia and 25° F. The additional refrigeration recovered through exchanger 75 is at a higher temperature level of about −5° F. and amounts to 68 tons of refrigeration per million standard cubic feet of transmission pipeline gas processed hourly in accordance with the flow diagram of FIG. 2 as modified by FIG. 3. The additional refrigeration obtained with exchanger 75 does not diminish the 95 tons of low level refrigeration recovered through exchanger 33.

Downstream of exchanger 75 some conditions change but none of the changes are of any importance. Thus, the gas leaves exchanger 26 at 53° F. instead of 18° F. when exchanger 75 was not present. Because the gas in line 35 is now warmer, the portion diverted through line 38 and reflux condenser 39 is increased to 11% of the gas issuing from exchanger 26. The recombined gas stream entering exchanger 36 is at 58° F. The aqueous methanol from separator 31 leaves exchanger 26 at 53° F. The gas entering exchanger 36 is at 162° F. but is still delivered to branch pipeline 47 at 70° F. and 305 psia as in the example of FIG. 2.

Hence, FIG. 3 yields 70% more refrigeration than FIG. 2 but the additional refrigeration made available by exchanger 75 is at a temperature level of about −5° F. whereas the low level refrigeration is available at a temperature of about −55° F. In short, FIG. 3 is justified when there are customers who require refrigeration at different temperature levels for their respective operations, for example, a customer utilizing low level refrigeration to freeze fish and a customer utilizing high level refrigeration in a cold storage warehouse. Generally, low level refrigeration is recovered at a temperature below about −40° F. and high level refrigeration is recovered at a temperature below about 20° F.

Processes for dehydrating gas are well known. Solid or liquid desiccants are used in some of the processes. However, in the absence of unusual circumstances, it is believed that the injection of methanol into pipeline gas and its recovery for continuous reuse as already described with reference to FIG. 2 is economically more attractive than the known processes for dehydrating gas.

Many variations and modifications of the invention will be apparent to those skilled in the art without departing from the spirit and scope of the invention. For example, pump 60 may discharge into line 42 just before it enters air cooler 43. A water-cooled exchanger could be used in place of air cooler 43. Similarly, in FIG. 3 the cold gas in line 32 may flow through a single exchanger, replacing exchangers 33 and 75, in countercurrent relation to a heat transfer fluid entering the warm end of the exchanger and exiting at an intermediate portion of the exchanger where another heat transfer fluid would enter for flow to, and withdrawal from, the cold end of the exchanger. The first mentioned heat transfer fluid would convey refrigeration to the customer requiring high level refrigeration and the other heat transfer fluid would convey refrigeration to the customer requiring low level refrigeration. Of course, high level refrigeration can also be obtained in FIG. 1 by placing another refrigeration recovery exchanger in line 13 between exchangers 14 and 11. On the other hand, if refrigeration of only somewhat higher temperature level is desired, exchanger 11 may be eliminated from FIG. 1 so that the system then has only three units: turboexpander 12, refrigeration recovery exchanger 14 and centrifugal compressor 16. Accordingly, only such limitations should be imposed on the invention as are set forth in the appended claims.

What is claimed is:

1. A process for delivering transmission pipeline gas at elevated pressure to a branch pipeline at a predetermined lower high pressure, which comprises recovering commercially saleable refrigeration by injecting methanol into said transmission pipeline gas, expanding said transmission pipeline gas containing said methanol with the performance of work to a reduced pressure at least 50 psi below said predetermined high pressure but not reduced enough to drop the temperature of the expanded gas below about −100° F., separating an aqueous methanol condensate from the cold expanded gas, recovering said commercially saleable refrigeration from said cold expanded gas, and thereafter compressing solely with said performance of work said expanded gas to said predetermined high pressure for delivery to said branch pipeline.

2. The process of claim 1 wherein the elevated pressure is in the range of about 400 to 1000 psia and the predetermined high pressure is in the range of about 200 to 450 psia.

3. The process of claim 1 wherein the transmission pipeline gas containing the methanol prior to expansion is cooled to a temperature below about 45° F. by heat exchange with the cold expanded gas after refrigeration has been recovered therefrom.

4. The process of claim 3 wherein refrigeration is recovered from the cold expanded gas at a temperature below about −40° F. and thereafter additional refrigeration is recovered from said cold expanded gas at a temperature below about 20° F. before the transmission pipeline gas is cooled by heat exchange with said cold expanded gas.

5. The process of claim 4 wherein the elevated pressure is in the range of about 500 to 800 psia and the predetermined high pressure is in the range of about 250 to 350 psia.

6. The process of claim 3 wherein the separated aqueous methanol condensate is subjected to distillation to recover and recycle methanol for injection into the transmission pipeline gas, said distillation receiving reflux cooling from the cold expanded gas which is then warmed by heat exchange with the compressed gas and which after compression provides reboiler heat to said distillation prior to warming said cold expanded gas by said heat exchange.

7. The process of claim 6 wherein part of the water bottoms from the distillation is admixed with the separated aqueous methanol condensate to cause hydrocarbons to separate therefrom as a supernatant layer on the admixture of said aqueous methanol and water bottoms, and subjecting said admixture to said distillation.

8. The process of claim 7 wherein the separated aqueous methanol condensate is warmed by heat exchange with the transmission pipeline gas before being admixed with the water bottoms.

9. The process of claim 6 wherein the elevated pressure is in the range of about 500 to 800 psia, the predetermined high pressure is in the range of about 250 to 350 psia, and refrigeration is recovered from the cold expanded gas at a temperature below about −40° F.

10. A process for delivering transmission pipeline gas at an elevated pressure in the range of about 400 to 1000 psia to a branch pipeline at a predetermined lower pressure in the range of about 200 to 450 psia, which comprises recovering commercially saleable refrigeration by injecting methanol into said transmission pipeline gas, expanding said transmission pipeline gas containing said methanol with the performance of work to reduce said elevated pressure at least 250 psi to a reduced pressure at least 50 psi below said predetermined pressure but not reduced enough to drop the temperature of the expanded gas below about −100° F., separating an aqueous methanol condensate from said expanded gas, recovering said commercially saleable refrigeration from said expanded gas, and utilizing said performance of work to compress said expanded gas for delivery to said branch pipeline at said predetermined pressure.

11. The process of claim 10 wherein the transmission pipeline gas together with the injected methanol prior to expansion is cooled to a temperature below about 45° F. by heat exchange with the expanded gas after the recovery of refrigeration therefrom.

12. The process of claim 11 wherein refrigeration is recovered from the expanded gas at a temperature below about −40°F.

13. The process of claim 12 wherein the separated aqueous methanol condensate is subjected to distillation to recover and recycle methanol for injection into the transmission pipeline gas, said distillation receiving reflux cooling from the expanded gas which is then warmed by heat exchange with the compressed gas, said compressed gas providing reboiler heat to said distillation prior to warming said expanded gas by said heat exchange.

14. The process of claim 13 wherein the separated aqueous methanol condensate is warmed by heat exchange with the transmission pipeline gas and is admixed with part of the water bottoms from the distillation to cause hydrocarbons to separate therefrom as a supernatant layer on the admixture of said aqueous methanol and water bottoms, and subjecting said admixture to said distillation.

15. The process of claim 13 wherein the elevated pressure is in the range of about 500 to 800 psia, the predetermined pressure is in the range of about 250 to 350 psia, and additional refrigeration is recovered from the expanded gas at a temperature below about 20° F. before the transmission pipeline gas is cooled by heat exchange with said expanded gas.

16. A process for delivering transmission pipeline gas at elevated pressure to a branch pipeline at a predetermined lower high pressure, which comprises recovering commercially saleable refrigeration by injecting methanol into said transmission pipeline gas, expanding said gas containing said methanol with the performance of work to reduce the pressure thereof at least 250 psi to a pressure at least 50 psi below said predetermined pressure, the pressure reduction being controlled to prevent the temperature of the expanded gas from falling below about −100° F., separating an aqueous methanol condensate from said expanded gas, recovering said commercially saleable refrigeration from said expanded gas, and compressing said expanded gas for delivery of the compressed gas to said branch pipeline at said predetermined pressure, the aforesaid performance of work being utilized to compress said expanded gas.

17. The process of claim 16 wherein the elevated pressure is at least about 500 psia, the predetermined pressure is at least about 250 psia, and the transmission pipeline gas containing the methanol prior to the expansion thereof is cooled to a temperature below about 45° F. by heat exchange with the expanded gas after the recovery of refrigeration therefrom.

* * * * *